US007267581B2

(12) United States Patent
Triplett et al.

(10) Patent No.: US 7,267,581 B2
(45) **Date of Patent: *Sep. 11, 2007**

(54) METHODS AND APPARATUS FOR MAINTAINING CONTACT WITH AN OUTLET PRONG CONNECTOR

(75) Inventors: Carl Triplett, Scottsdale, AZ (US); Christopher J Wolpert, Scottsdale, AZ (US); Kevin Hafer, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 27 days.

This patent is subject to a terminal disclaimer.

(21) Appl. No.: 11/163,952

(22) Filed: Nov. 4, 2005

(65) Prior Publication Data

US 2006/0160426 A1 Jul. 20, 2006

Related U.S. Application Data

(63) Continuation-in-part of application No. 10/924,376, filed on Aug. 23, 2004, now Pat. No. 6,962,509.

(51) Int. Cl.
*H01R 33/92* (2006.01)

(52) U.S. Cl. ..... 439/651; 439/682

(58) Field of Classification Search ..... 439/222, 439/382, 682, 651, 695, 599, 857, 752
See application file for complete search history.

(56) References Cited

U.S. PATENT DOCUMENTS

| | | | | |
|---|---|---|---|---|
| 1,979,958 | A | 11/1934 | Clark, Jr. | |
| 2,316,072 | A | 4/1943 | Judisch | |
| 2,443,797 | A | 6/1948 | Miller | |
| 4,275,374 | A | 6/1981 | Chaucer | |
| 4,500,160 | A | 2/1985 | Bertsch | |
| 4,606,597 | A | 8/1986 | Bielefeld | |
| 4,768,965 | A * | 9/1988 | Chang | 439/137 |

* cited by examiner

*Primary Examiner*—Tho D. Ta
(74) *Attorney, Agent, or Firm*—Snell & Wilmer LLP

(57) ABSTRACT

A plug stabilizing apparatus includes a prong connector well-secured by a receptacle chamber. The connect has a prong portion, a clip portion, and a neck support situated therebetween, wherein the clip portion is configured to accept a prong having substantially the same dimensions as the prong portion of the connector (e.g., prongs such as those used in connection with standard household plugs), and the clip portion includes one or more distal protrusions extending outwardly therefrom. Support pads are located between said neck support and/or distal protrusions and a back housing surface of a vaporizer device. The receptacle chamber has a first end configured to contact the neck support, a second end including an elongated opening and at least two clip supports configured to accept the distal protrusions, and a guide structure configured to guide the distal protrusions into the clip supports.

16 Claims, 5 Drawing Sheets

METHODS AND APPARATUS FOR MAINTAINING CONTACT WITH AN OUTLET PRONG CONNECTOR

CROSS-REFERENCE TO RELATED APPLICATIONS

This application is a continuation in part of U.S. patent application Ser. No. 10/924,376 entitled "Methods and Apparatus for A Stabilized Outlet Prong Connector" filed Aug. 23, 2004, now U.S. Pat. No. 6,962,509 which is incorporated herein by reference.

FIELD OF INVENTION

The present invention generally relates to electrical connectors and, more particularly, to a stabilized plug system for use in pass-through outlet plug connections and for maintaining contact between electrical connections.

BACKGROUND OF INVENTION

Certain classes of compact electrical devices are designed to plug directly into an electrical outlet and remain mechanically supported by the outlet itself. In such cases, it may be desirable to include a corresponding outlet in the device, thereby maintaining the functionality of the outlet.

Referring to FIGS. 1 and 2, for example, a standard outlet fixture 108 includes a clip structure 106 which electrically communicates with a power source (not shown), and which is configured to accept corresponding prongs 104 of an electrical plug 102. As shown in FIG. 2, an intermediate device 208 might include a prong connector 202 which itself includes prongs 206 and a clip structure 204. When plug 102 is plugged into an outlet 209 through front surface 205 of intermediate device 208, prongs 104 of plug 102 are electrically continuous with clip structure 106, thereby providing "pass-through" functionality of outlet fixture 108.

Known devices of this type are unsatisfactory in a number of respects. For example, prong connector structures used in such devices are not sufficiently supported, allowing for undesirable movement of the prongs extending from the intermediate device. More particularly, referring to FIGS. 3, 4, and 5, a prior art prong connector 202 includes a prong 206, a support neck 304, and a clip region 302. Connector 202 fits through an end 404 of a receptacle chamber 209. When a prong from, for example, an electrical plug, is inserted through opening 402 of chamber 209, it is received by clip region 204 and held in place via compression supplied by pinch region 302. As shown in FIG. 5, however, this design allows prong 206 to rotate undesirably, which in turn compromises the structural strength of the apparatus when inserted into an outlet.

Accordingly, there is a need for outlet connectors that overcome these and other limitation of the prior art.

SUMMARY OF INVENTION

In general, the present invention provides a plug stabilizing apparatus including a prong connector well-secured by a receptacle chamber. The connect has a prong portion, a clip portion, and a neck support situated therebetween, wherein the clip portion is configured to accept a prong having substantially the same dimensions as the prong portion of the connector (e.g., prongs such as those used in connection with standard household plugs), and the clip portion includes one or more distal protrusions extending outwardly therefrom. Support pads are located between said neck support and/or distal protrusions and a back housing surface of a vaporizer device. The receptacle chamber has a first end configured to contact the neck support, a second end including an elongated opening and at least two clip supports configured to accept the distal protrusions, and a guide structure configured to guide the distal protrusions into the clip supports.

In accordance with a further aspect of the present invention, the receptacle chamber includes a lead-in region on the inner surface of the receptacle chamber between the first end and the guide structure.

In accordance with another aspect of the present invention, the guide structure includes four surfaces running diagonally from the first end to the clip supports.

In accordance with one embodiment of the present invention, the plug stabilizing apparatus is a component of an intermediate device, e.g., an air-freshener or the like.

In accordance with another embodiment of the present invention, the neck support of said connector is configured to contact an electrical device contained within the intermediate device.

BRIEF DESCRIPTION OF THE DRAWINGS

A more complete understanding of the present invention may be derived by referring to the detailed description when considered in connection with the Figures, where like reference numbers refer to similar elements throughout the Figures, and.

DETAIL DESCRIPTION

Figure 1:
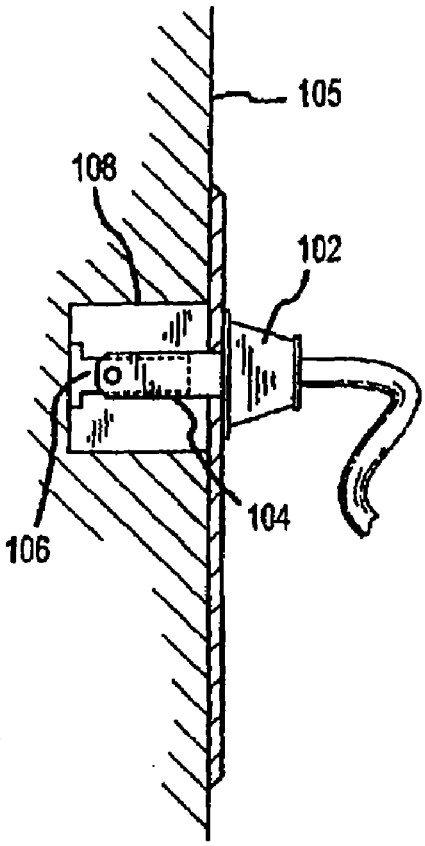
FIG. 1 is a side view of a typical prior art electrical plug interfacing with a wall outlet.
Figure 2:
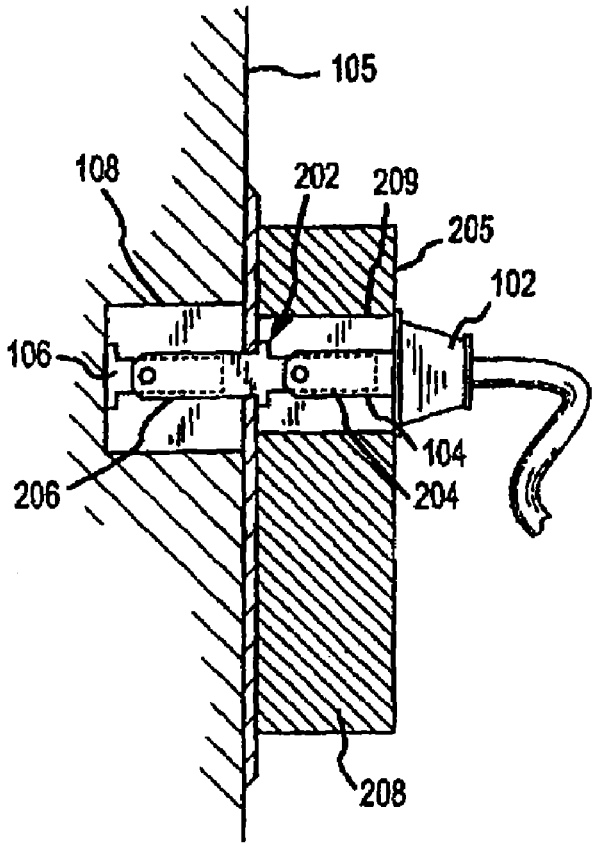
FIG.2 PRIOR ART
FIG. 2 is a side view of an electrical plug interfacing with an intermediate device which itself includes a plug interfacing with a wall outlet.
Figure 3:
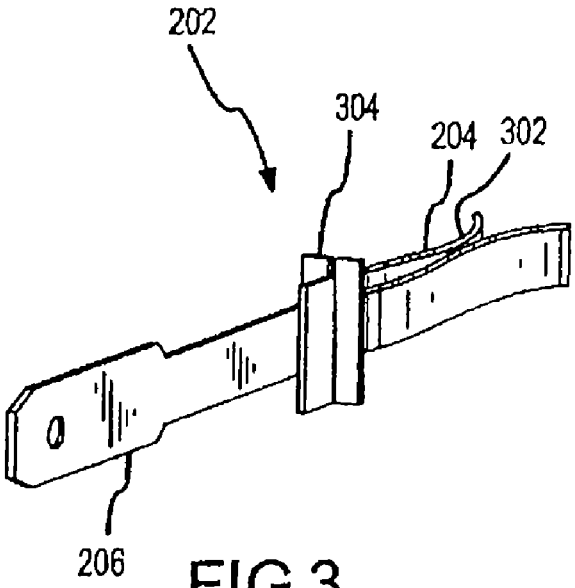
FIG. 3 is an isometric overview of a prior art prong connector.
Figure 4:
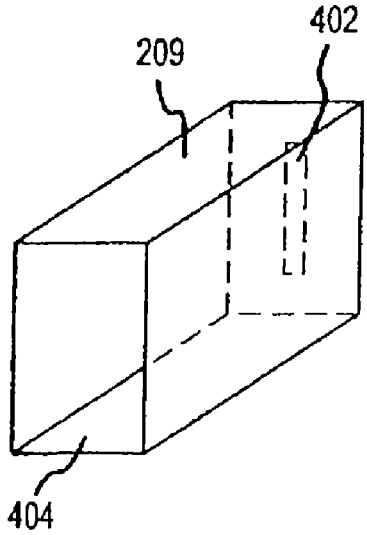
FIG. 4 is an isometric overview of a prior art receptacle chamber configured to accept the prong connector depicted in FIG. 3.
Figure 5:
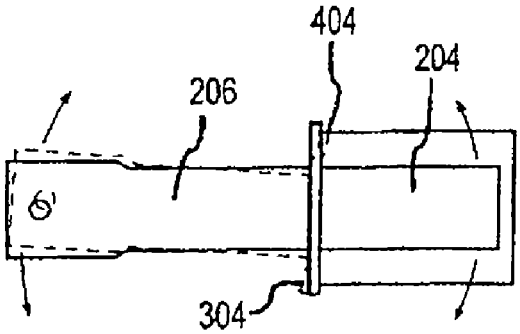
FIG.5 PRIOR ART
FIG. 5 is a side view illustrating the rotational instabilities resulting from the combination of the prong connector and receptacle chamber shown in FIGS. 3 and 4.
Figure 6:
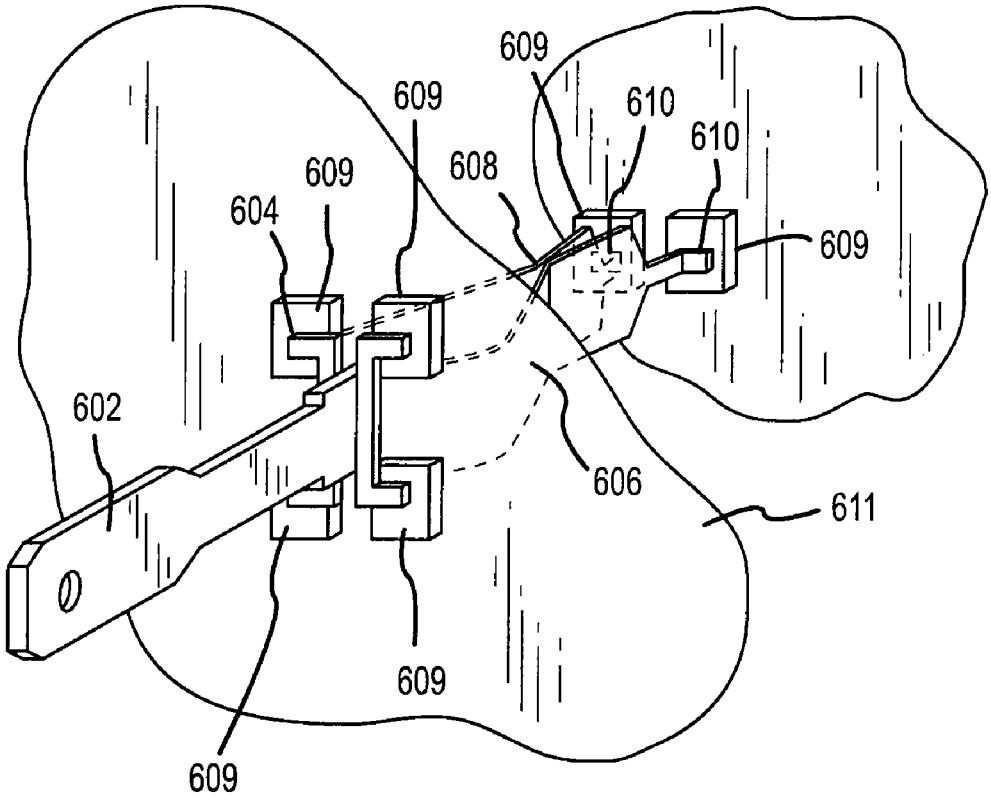
FIG. 6 is an isometric overview of a prong connector in accordance with one embodiment of the present invention.

The following description is of exemplary embodiments of the invention only, and is not intended to limit the scope, applicability or configuration of the invention in any way. Rather, the following description is intended to provide a convenient illustration for implementing various embodiments of the invention. As will become apparent, various changes may be made in the function and arrangement of the elements described in these embodiments without departing from the scope of the invention. The plug stabilizing apparatus of claim 1, wherein said plug stabilizing apparatus is a component of an intermediate device In general, the present invention is directed to a plug stabilizing apparatus including a prong connector disposed within and secured by a receptacle chamber. With reference to FIG. 6, a prong connector (or simply "connector") in accordance with one embodiment of the present invention includes a prong portion 602, a clip portion 606, and a neck support 604 provided between the prong and clip portions.

Clip portion 606 is configured to accept a prong, e.g., a prong having substantially the same dimensions as prong portion 602 of the connector. A prong inserted into clip portion 606 is preferably secured via lateral compression applied at the pinch region 608 of clip 606, wherein pinch region 608 has any convenient shape. Such clip structures may be configured, for example, to accept the prongs of standard household electrical plugs.

Neck support 604 comprises any structure or structures provided to partially prevent axial movement of the connector within the receptacle chamber, as described further below. In this regard, neck support 604 as illustrated includes two or more rectangular protrusions; however, any curvilinear structure, rectilinear structure, or combination thereof may be used.

Clip portion 606 includes one or more distal protrusions 610 extending outwardly, i.e., orthogonal to the major axis of the connector. Distal protrusions 610 have any suitable shape, including rounded, angular, etc. In the preferred embodiment, clip region includes two distal protrusions centered at the extreme ends of clip region 606. Additionally, in accordance with various embodiments of the present invention, one or more support pads 609 are located between one or more of neck supports 604 and/or, alternatively or in addition to, distal portions 610 and a backing of the device 611 into which prong portion 202 is inserted (e.g., a vaporizing device), in order to further stabilize and or maintain connection of the protrusions with for example, as described below, printed circuits. The illustrated support pads 609 have a generally rectangular cross-section, though any number of shapes and configurations may be used. Additionally, in a preferred embodiment, support pads 609 comprise a material which is semi-flexible, such as a rubber, foam rubber, or the like, such that there is flexibility for assembly of the device, but to suitably aid in supporting the neck supports 604 by providing a compression force on neck support 604 and/or distal protrusions 610.

Figure 7:
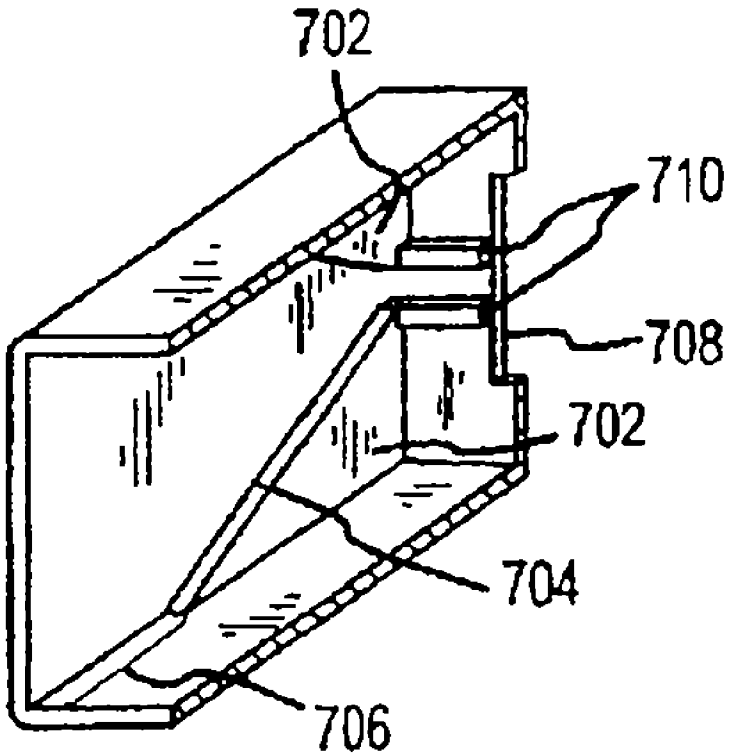
FIG. 7 is an partial cut-away view of a receptacle chamber in accordance with one embodiment of the present invention.

With reference to FIG. 7 in conjunction with FIG. 6, the receptacle chamber (a half cut-away of which is shown) has a first end configured to contact neck support 604, and a second end opposite the second end that includes an elongated opening 708 and at least two clip supports 710 configured to accept distal protrusions 610. Receptacle chamber may also include a lead-in region 706 leading from the first end to the guide structures.

The connector of FIG. 6 is inserted axially into FIG. 7 through the large opening. As the connector is being inserted, distal protrusions 610 contact guide structures 702 along bearing surfaces 704, thereby helping to align the connector as it is being inserted. When the connector is fully inserted, guide structures 702 help guide distal protrusions 610 such that they are seated between clip supports 710. At the same time, neck support 604 contacts the outer edge of the first end of the receptacle chamber. As a result, the connector is substantially restrained from rotational movement.

In the illustrated embodiment, guide structures 702 includes four generally triangular ramps (two for each half) having corresponding bearing surfaces 704. The invention is not so limited, however, as any number and shape of structures may be used. The present invention comprehends, for example, smooth, ratcheted, or textured bearing surfaces 704. Similarly, guide structures 702 may have any suitable size and shape, including parabolic, linear, etc.

The plug stabilizing apparatus formed from the illustrated connector and receptacle chamber may be incorporated into a variety of applications and intermediate devices. In one embodiment, for example, the apparatus of the invention is used in connection with a vapor-dispensing device (e.g., an air-freshener) that is positioned over an electrical outlet, but which includes its own outlets. In such a case, it is advantageous to use at least one plug stabilizing apparatus to maintain "plug-through" functionality of the outlet.

In accordance with a further embodiment, the neck support 604 of the connector is configured such that it makes contact with electrical components within the intermediate device itself. That is, one or more of the neck supports 604 make contact with a printed circuit board (PCB) or the like within the device in order to provide electrical power. Contact between neck support 604 and the PCB may be maintained via an interference fit or any suitable bonding technique.

Figure 8:
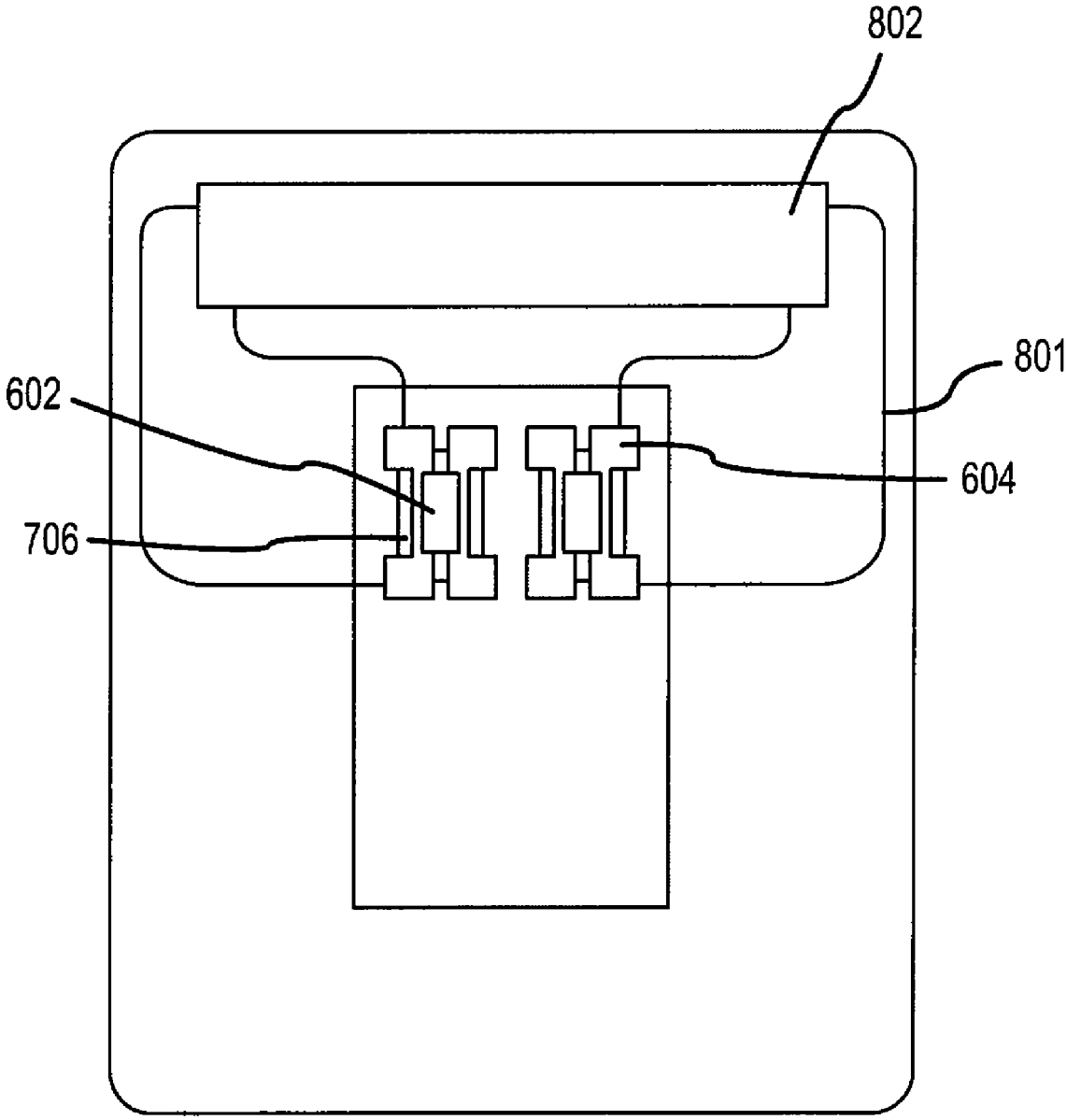
FIG. 8 is a back view of an intermediate device with the neck support configured to contact an electrical device within said intermediate device in accordance with one embodiment of the present invention.

In accordance with another embodiment of the present invention, FIG. 8, neck supports 604 make contact with a flexible printed circuit 801, for example, a flexible printed circuit configured as a resistive heater element. In one embodiment, supports 604 make contact to opposite ends of a resistive heater element 802 which is in thermal communication with a vapor-releasing substance, i.e., an oil or water-based fragrance solution.

Other advantages and structural details of the invention will be apparent from the attached figures, which will be well understood by those skilled in the art. The present invention has been described above with to a particular exemplary embodiment. However, many changes, combinations and modifications may be made to the exemplary embodiments without departing from the scope of the present invention.

What is claimed is:

1. A plug stabilizing apparatus for a vaporizing device having a back housing surface, comprising:

a connector having a prong portion, a clip portion, and a neck support situated therebetween, wherein said clip portion is configured to accept a prong having substantially the same dimensions as said prong portion of said connector, and wherein said clip portion includes distal protrusions extending outward therefrom;

a receptacle chamber having a first end, said neck support contacts an outer edge of said first end, a second end including an elongated opening and said second end also including at least two clip supports configured to accept said distal protrusions, and a guide structure configured to guide said distal protrusions into said clip supports when said connector is inserted into said first end of said receptacle chamber; and a support pad located between said neck support and the back housing surface.

2. The plug stabilizing apparatus of claim 1, further including a lead-in region on the inner surface of said receptacle chamber between said first end and said guide structure.

3. The plug stabilizing apparatus of claim 1, wherein said guide structure includes four surfaces extending substantially diagonally from said first end to said clip supports.

4. The plug stabilizing apparatus of claim 1, wherein said prong portion is configured to fit within an electrical outlet.

5. The plug stabilizing apparatus of claim 1, further comprising a second support pad between another of said neck supports and said back housing surface.

6. The plug stabilizing apparatus of claim 1, wherein said plug stabilizing apparatus is a component of an intermediate device.

7. The plug stabilizing apparatus of claim 6, wherein said intermediate device comprises an air-freshener.

8. The plug stabilizing apparatus of claim 7, wherein the neck support of said connector is configured to contact an electrical device contained within said intermediate device.

9. A plug stabilizing apparatus for a vaporizing device having a back housing surface, comprising:

a connector having a prong portion, a clip portion, and a neck support situated therebetween, wherein said clip portion is configured to accept a prong having substantially the same dimensions as said prong portion of said connector, and wherein said clip portion includes distal protrusions extending outward therefrom;

a receptacle chamber having a first end, said neck support contacts an outer edge of said first end, a second end including an elongated opening and said second end also including at least two clip supports configured to accept said distal protrusions, and a guide structure configured to guide said distal protrusions into said clip supports when said connector is inserted into said first end of said receptacle chamber; and a support pad located between one of said distal protrusions and the back housing surface.

10. The plug stabilizing apparatus of claim 9, further comprising a second support pad between another of said distal protrusions and said back housing surface.

11. The plug stabilizing apparatus of claim 9, further including a lead-in region on the inner surface of said receptacle chamber between said first end and said guide structure.

12. The plug stabilizing apparatus of claim 9, wherein said guide structure includes four surfaces extending substantially diagonally from said first end to said clip supports.

13. The plug stabilizing apparatus of claim 9, wherein said prong portion is configured to fit within an electrical outlet.

14. The plug stabilizing apparatus of claim 9, wherein said plug stabilizing apparatus is a component of an intermediate device.

15. The plug stabilizing apparatus of claim 14, wherein said intermediate device comprises an air-freshener.

16. The plug stabilizing apparatus of claim 15, wherein the neck support of said connector is configured to contact an electrical device contained within said intermediate device.

* * * * *